US006827556B2

(12) United States Patent
Simon

(10) Patent No.: US 6,827,556 B2
(45) Date of Patent: Dec. 7, 2004

(54) MOVING BLADE FOR A TURBOMACHINE AND TURBOMACHINE

(75) Inventor: Volker Simon, Ruhr (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/379,987

(22) Filed: Mar. 5, 2003

(65) Prior Publication Data

US 2003/0185685 A1 Oct. 2, 2003

Related U.S. Application Data

(63) Continuation of application No. PCT/EP01/09759, filed on Aug. 23, 2001.

(30) Foreign Application Priority Data

Sep. 5, 2000 (EP) ..... 00119203

(51) Int. Cl.[7] ..... F01D 5/28
(52) U.S. Cl. ..... 416/241 R; 415/200
(58) Field of Search ..... 415/200; 416/223 R, 416/223 A, 241 R, 229 R, 229 A

(56) References Cited

U.S. PATENT DOCUMENTS 3,566,493 A 3/1971 Poucher et al.
3,695,778 A 10/1972 Taylor
3,778,188 A * 12/1973 Aspinwall ..... 416/97 R
3,810,286 A 5/1974 Kaufman, Sr.
4,422,229 A * 12/1983 Sadler et al. ..... 29/889.721
5,073,459 A 12/1991 Smarsly et al.
5,295,789 A 3/1994 Daguet
5,634,189 A 5/1997 Rossmann et al.
5,634,771 A * 6/1997 Howard et al. ..... 416/241 A
6,544,003 B1 * 4/2003 Grylls et al. ..... 416/234

OTHER PUBLICATIONS

Baxter, N. E. et al.: "Metallic Foams From Alloy Hollow Spheres", The Minerals, Metals & Materials Society, 1997, pp. 417–430.

* cited by examiner

*Primary Examiner*—Ninh H. Nguyen
(74) *Attorney, Agent, or Firm*—Laurence A. Greenberg; Werner H. Stemer; Ralph E. Locher

(57) ABSTRACT

A novel blade configuration does not exceed the permitted stresses for particular loads, especially as a result of centrifugal forces and which at the same time, allows the turbomachine to function with a high degree of efficiency. To this end, a moving blade for the turbomachine contains at least partially a cellular material, especially a foamed metal. The cellular material can be provided e.g. in the hollowed-out part of the moving blade.

13 Claims, 5 Drawing Sheets

MOVING BLADE FOR A TURBOMACHINE AND TURBOMACHINE

CROSS-REFERENCE TO RELATED APPLICATION

This application is a continuation of copending International Application No. PCT/EP01/09759, filed Aug. 23, 2001, which designated the United States and was not published in English.

BACKGROUND OF THE INVENTION

Field of the Invention

The invention relates to a moving blade for a turbomachine. The invention relates, furthermore, to a turbomachine with a moving blade.

Moving blades for turbomachines, for example moving blades for high-pressure, medium-pressure or low-pressure part turbines of a steam turbine or gas turbine moving blades for compressors or turbines, are conventionally produced from homogeneous metallic alloys. In this case, in addition to milling methods, casting and forging techniques are also used. The metallic raw material is in this case melted and subsequently rolled as bar stock or forged as a blade blank.

A turbomachine of this type contains an individual rotor or a number of rotors that are disposed one behind the other in the axial direction and around the moving blades of which a gaseous or vaporous flow medium flows during operation. The flow medium in this case exerts on the moving blades a force which gives rise to a torque over the rotor or blade wheel and consequently to the working power output. For this purpose, the moving blades are conventionally disposed on a rotatable shaft of the turbomachine, of which the guide vanes disposed on corresponding guide wheels are disposed on the stationary casing, the casing of the turbomachine, the casing surrounding the shaft so as to form a flow duct.

Whereas, in a compressor, mechanical energy is supplied to the flow medium, in a turbine functioning as a turbomachine mechanical energy is extracted from the flow medium flowing through. In a conventional turbomachine with a shaft rotating during operation and with a stationary casing, the centrifugal force in each moving blade fastened to the shaft generates a tensile load on which is superposed a bending load caused by the flow forces of the flow medium. This results in a critical load at those points in the blade foot and in the shaft at which the bending tensile stress and the tensile stress as a result of centrifugal forces are superposed on one another. Owing to the critical load, there is a limit to the blade height in its radial dimension and consequently to the efficiency of the turbomachine.

In particular, the moving blades of steam turbine low-pressure parts (LP moving blades) are predominantly loaded by centrifugal forces as a result of the rotation of the shaft. The load is therefore directly proportional to the density of the blade material used. Since the densities of the materials used are very similar to that of iron, the load in the case of long LP blades is such that a specific blade length cannot be exceeded. This is important particularly for the higher stages of the LP blading, the radial dimensions of which are limited by the limits of the centrifugal force load. Due to the limited blade length, only a specific outlet cross section can be achieved for the flow medium, so that the flow medium, for example the exhaust steam of a low-pressure part turbine, leaves the turbomachine at a high velocity and consequently with high losses.

Previous solutions to the problem for LP moving blades provide for the use of materials consisting of titanium alloys in the case of very high blade lengths. As compared with alloys based on iron, cobalt or nickel, titanium alloys have a lower density, and therefore, with dimensions otherwise being the same, moving blades consisting of this material are subject to lower stresses than moving blades consisting of the metallic materials customary hitherto. The disadvantage of this solution to the problem is, however, that titanium alloys are very costly and the problem of the centrifugal force load persists, as before, albeit to a somewhat lesser extent.

SUMMARY OF THE INVENTION

It is accordingly an object of the invention to provide a moving blade for a turbomachine and a turbomachine which overcomes the above-mentioned disadvantages of the prior art devices of this general type, which specifies a blade configuration that, under the given loads in the turbomachine, does not exceed the permissible stresses and nevertheless allows high efficiency. A further object of the invention is to specify a turbomachine for high stresses, along with high efficiency.

With the foregoing and other objects in view there is provided, in accordance with the invention, a moving blade for a turbomachine. The moving blade has a moving blade body containing, at least in regions, a cellular material and an outer surface. The cellular material has cells forming the outer surface with a structure being closed with respect to the cells.

According to the invention, the object directed at the moving blade is achieved by the moving blade for the turbomachine, the moving blade containing, at least in regions, a cellular material.

As compared with the conventional configurations of moving blades for turbomachines, for example gas or steam turbines, the invention takes a completely new path. Although homogeneous metallic materials have been used hitherto for the moving blades, the concept of the invention is based on the structural configuration of the moving blade and of the materials forming it. By cellular materials being used for the moving blade, a considerable reduction in the average density for the moving blade is achieved. The cellular structure ensures a substantially lower density than homogeneous materials customary hitherto. Since the cellular material is disposed in regions in a specific way, moving blades according to the invention therefore give rise to substantially lower stresses as a result of centrifugal forces. Consequently, when cellular materials are used, moving blades with a markedly higher blade length can be produced, so that a larger flow cross section with lower losses when the moving blade is used in a turbomachine can be implemented.

Moreover, cellular materials have higher internal damping than homogeneous materials, so that they advantageously damp possible vibrations particularly efficiently. Furthermore, cellular materials exhibit good rigidity properties, so that, owing to the high specific strength, they have approximately the permissible load of comparable homogeneous materials. This is particularly advantageous in application in a turbomachine, where considerable thermomechanical loads are to be noted. By virtue of the specific selection of regions of the moving blade where the cellular material is provided, a load-adapted blade configuration can be specified for the moving blade. Depending on the application, therefore, different regions of the moving blade may have the cellular material.

The moving blade preferably has a blade leaf region with the cellular material. It is precisely the blade leaf region of a moving blade which, when the moving blade is used in a turbomachine, is exposed to particularly high blade stresses as result of the action of centrifugal force, since, as compared with other regions of the moving blade, the blade leaf region is at a greater radial distance from the axis of rotation. As a result of the markedly lower density, a blade leaf region having the cellular material undergoes a correspondingly lower centrifugal load.

Preferably, the moving blade has a fastening region, in particular a blade foot, the cellular material being provided in the fastening region. The fastening of a moving blade takes place normally on a rotatable shaft, a fastening region of the moving blade being connected to a corresponding reception region of the shaft. Various blade fastening concepts are known, for example pine tree slot connections or hammer head connections, to which the novel moving blade concept can be applied. By the cellular material being provided in the fastening region of the moving blade, the blade stresses in the fastening region, too, can be reduced correspondingly. By the combination of various regions of the moving blade in which the cellular material is provided, specific adaptation to the respective loads becomes possible. For example, the cellular material may be provided both in the blade leaf region and in the fastening region.

The moving blade may also be formed of as a whole of the cellular material, as a result of which, because of the reduction in density in relation to a comparable solid material, a lightweight form of construction of the moving blade is achieved overall. In terms of the physical properties, such as weight, hardness and flexibility, the cellular construction of the moving blade is far superior to the use of solid light metals, for example titanium alloys.

In a preferred embodiment, the moving blade has an inner region and a casing region surrounding the inner region, the cellular material being provided in the casing region and/or in the inner region.

Also preferably, the cellular material forms an outer surface with a structure that is closed with respect to the cells. This is particularly advantageous, insofar as the outer surface is a part surface of the blade leaf region of the moving blade, the blade leaf region being acted upon by a flow medium during operation. By the outer surface being produced with a closed structure, a surface, for example a surface in the blade leaf region, with correspondingly low roughness is provided. Insofar as the outer surface of the cellular structure is exposed to a flow medium, the flow resistances and consequently the flow losses are correspondingly low. Advantageously, due to the cellular structure of the material, an outer surface is provided which also has a highly damping action with respect to secondary losses as a result of transverse flows. For this purpose, for a possible transverse flow, the surface has barriers that may be formed along mutually contiguous cells of the cellular structure.

In a particularly preferred embodiment, the cellular material is a metal foam. Metal foams, above all, are lightweight construction materials with high potential and with a widespread field of use. Metal foams may be obtained by various production methods, for example by fusion and powder-metallurgic precipitation and sputtering techniques. In a powder-metallurgic method, by a metal powder being mixed with an expanding agent, for example metal hydride, an exchange material is produced, which, after subsequent axial hot pressing or extrusion, is compacted into a prefabricated semi-finished product which, by appropriate forming, can be adapted in a dimensionally accurate manner to a respective final product and, by corresponding heating, is properly foamed to just above the fusion temperature of the metal. The expanding agent which is contained in the semi-finished product, and for which titanium hydride is typically used, decomposes during heating and splits off hydrogen gas. The hydrogen occurring in gaseous form leads as a propellant to forming a corresponding pore formation in the metal melt. The metal foam porosity formed by the pores can in this case be set specifically for the duration of the foaming operation.

Preferably, the density of the metal foam is between about 5% and 50%, in particular between about 8% and 20%, of the density of the solid material.

Preferably, the metal foam consists of a material resistant to high temperature, in particular a nickel-based or cobalt-based alloy. The selection of a material resistant to high temperature is particularly advantageous especially for use in a gas turbine having turbine inlet temperatures of up to 1200° C. Use in a steam turbine with high steam states with a steam temperature of more than 600° C. is also made possible by the selection of material for the metal foam.

Preferably, the moving blade is configured as a gas turbine moving blade, a steam turbine moving blade, in particular a low-pressure steam turbine moving blade, or a compressor moving blade. In particular, the use of the moving blade in a low-pressure steam turbine appears to be particularly advantageous, because, due to the use of the cellular material, for example the metal foam, higher blade lengths, along with a lower centrifugal force load, can be implemented, as compared with the conventional moving blades. This has a beneficial effect directly on the efficiency of the turbomachine, for example of a low-pressure steam turbine.

The object directed at a turbomachine is achieved, according to the invention, by a turbomachine having a moving blade according to the statements made above.

The turbomachine is advantageously configured as a gas turbine, a steam turbine or a compressor.

The advantages of such a turbomachine may be gathered according to the statements relating to the moving blade.

Other features which are considered as characteristic for the invention are set forth in the appended claims.

Although the invention is illustrated and described herein as embodied in a moving blade for a turbomachine and turbomachine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
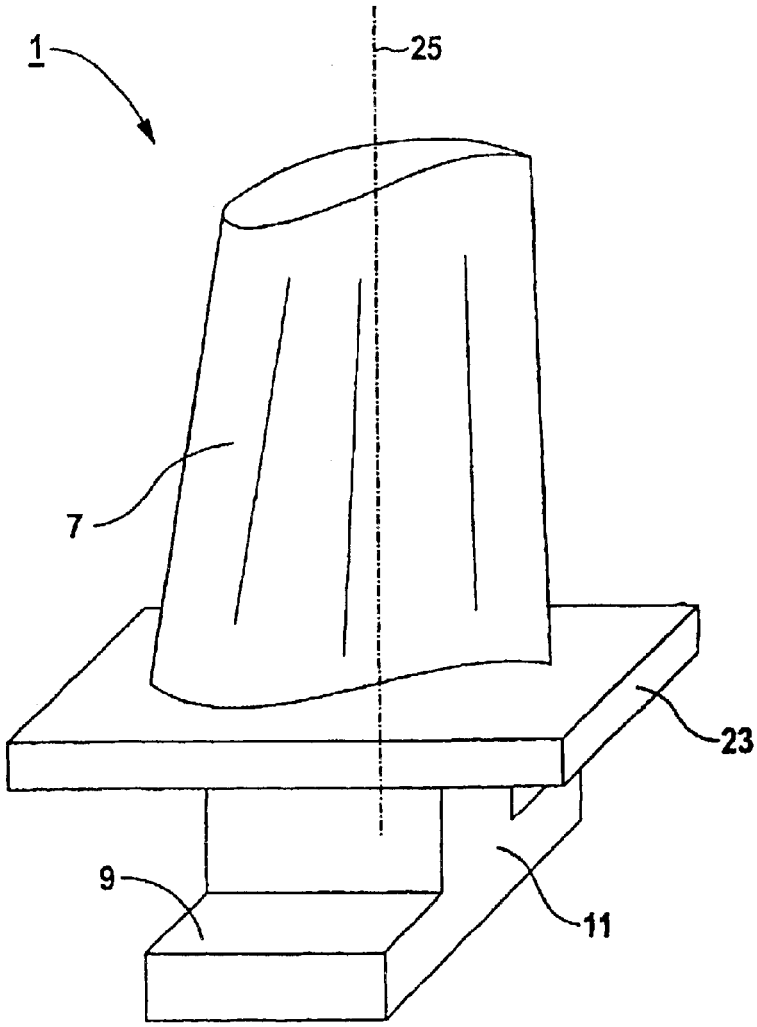
FIG 1 Prior Art
FIG. 1 is a diagrammatic, perspective view of a moving blade for a turbomachine according to the prior art.

In all the figures of the drawing, sub-features and integral parts that correspond to one another bear the same reference symbol in each case. Referring now to the figures of the drawing in detail and first, particularly, to FIG. 1 thereof, there is shown a perspective view of a moving blade 1 which extends along a longitudinal axis 25. The moving blade 1 has, successively along the longitudinal axis, a fastening region 9, a blade platform 23 contiguous to it and a blade leaf region 7. In the fastening region 9 is formed a blade foot 11 which serves for fastening the moving blade 1 to the shaft of a turbomachine (see FIG. 8) not illustrated in FIG. 1. The blade foot 11 is configured as a hammer head. Other configurations, for example as a pine tree or dovetail foot, are possible. In conventional moving blades 1, solid metallic materials are used in all the regions 9, 23, 7 of the moving blade 1. The moving blade 1 may in this case be manufactured by a casting method, a forging method, a milling method or combinations of these.

Figure 2:
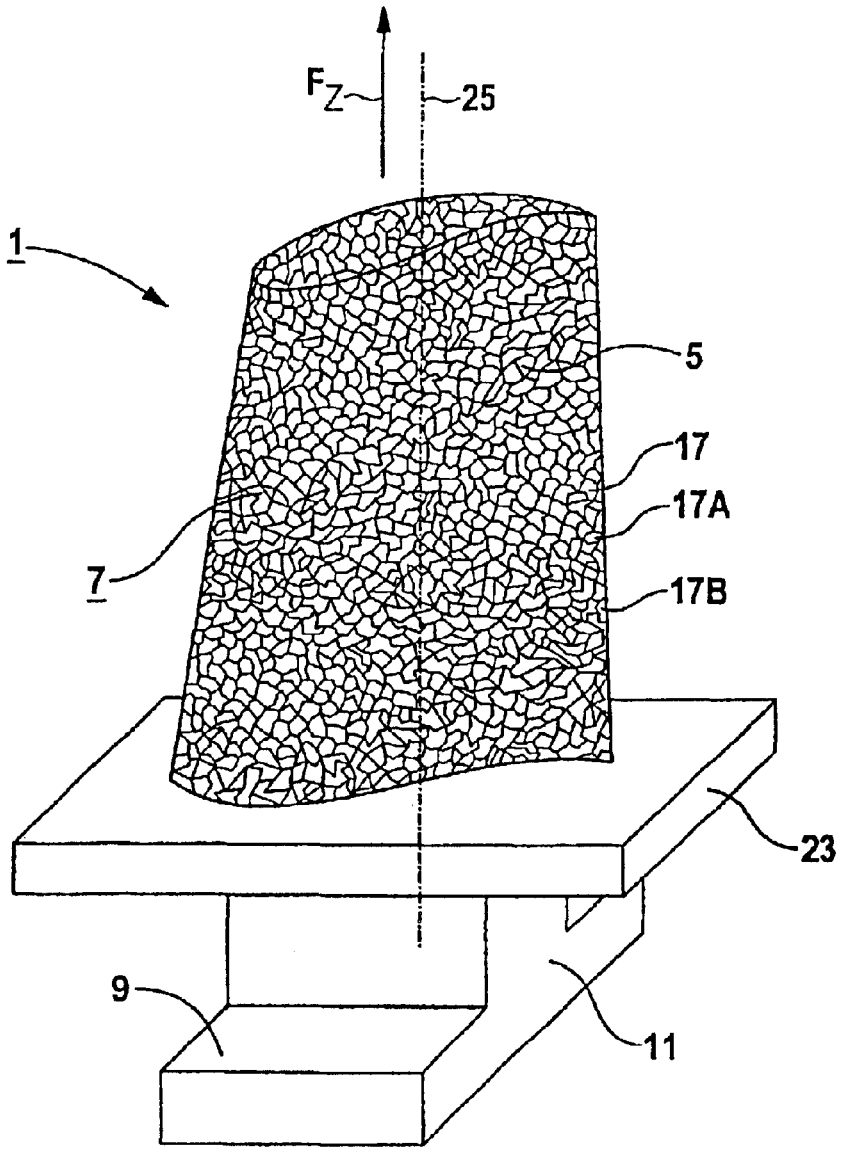
FIG. 2 is a perspective view of the moving blade for a turbomachine that consists in regions of a cellular material according to the invention.

The moving blade 1 according to the invention is illustrated in FIG. 2. As compared with the conventional moving blade 1 shown in FIG. 1, the moving blade 1 is formed of, in regions, of a cellular material 5.

The cellular material 5 is in this case provided in the blade leaf region 7 of the moving blade 1, the entire blade leaf region 7 having the cellular material 5. The cellular material 5 has a multiplicity of cells 17, 17*a*, 17*b*. The cellular construction of the cellular material 5 may be such that a closed porous structure is achieved, each of the cells 17, 17*a*, 17*b* being closed. In an alternative configuration of the cellular material, the cells 17, 17A, 17B may also form an at least partially non-closed porous structure. By the cellular material 5 being provided in the blade leaf region 7, a region 7 with a markedly reduced material density is afforded in the blade leaf region 7, as compared with conventional moving blades 1 with the use of solid material (see FIG. 1). This is achieved by virtue of the cellular structure of the material 5. Due to the reduced density in the blade leaf region 7, in an operational situation, that is to say, for example, when the moving blade 1 is used in a turbomachine, a considerable reduction in the load as a result of a centrifugal force $F_z$ directed radially outward along the longitudinal axis 25 is achieved. The region of the moving blade 1 which experiences a higher centrifugal force $F_z$ because of the greater radial distance from the axis of rotation, to be precise the blade leaf region 7, is in this case provided specifically with the cellular material. The invention makes it possible to adapt to the respective requirements that depend on the application and on the loads prevailing as a result on the moving blade 1. In this case, as compared with conventional concepts, the structural properties of the materials are for the first time taken into account and advantageously employed.

The cellular material 5 may be provided in different regions 9, 23, 7 of the moving blade 1. In order to illustrate this flexibility, FIG. 3 shows a perspective illustration of the moving blade 1 with a configuration, modified as compared with the moving blade 1 illustrated in FIG. 2, in terms of the introduction of the cellular material 5.

For the sake of simplicity and clarity, this is illustrated by the details X1 and X2 of the moving blade 1. The cellular material 5 is introduced, according to detail X1, in the fastening region 9 and, according to detail X2, in the region of the blade platform 23. The details X1 and X2 in this case represent, by way of example, part regions of the fastening region 9 and of the blade platform 23 respectively. Of course, in one advantageous embodiment, the entire fastening region 9 and/or the region of the blade platform 23 may consist of the cellular material 5. The cellular material 5 in this case contains a multiplicity of the cells 17.

Figure 3:
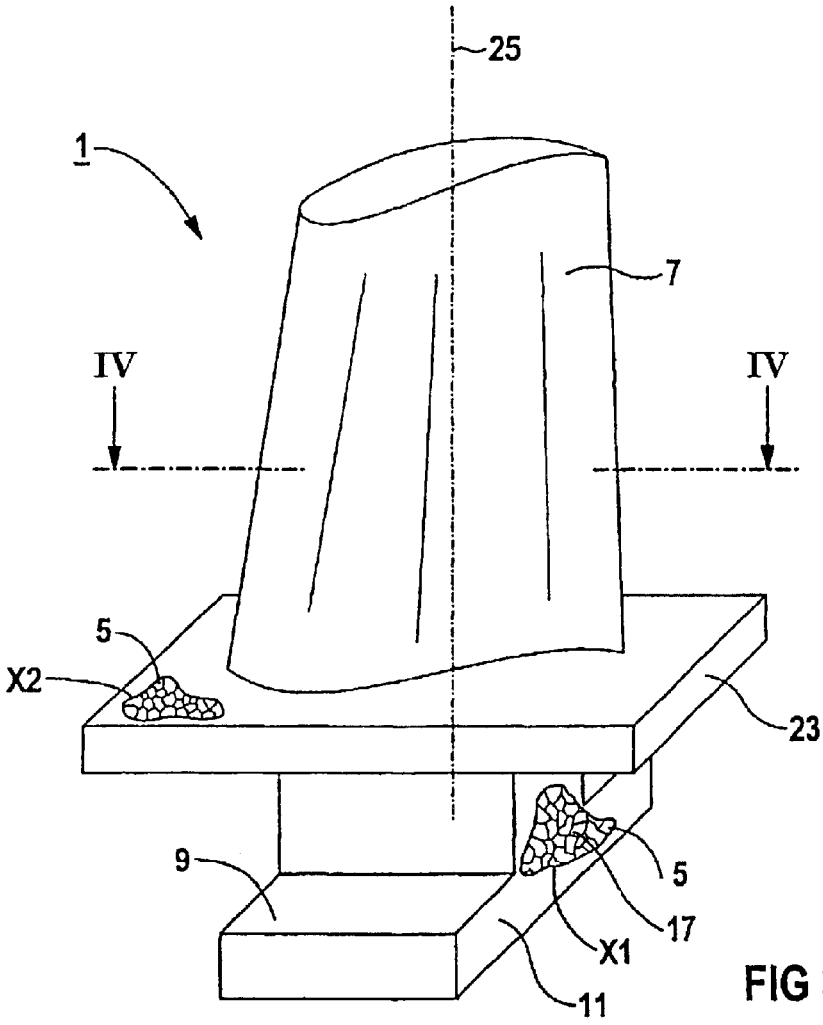
FIG. 3 is a perspective illustration of the moving blade modified in relation to FIG. 2.
Figure 4:
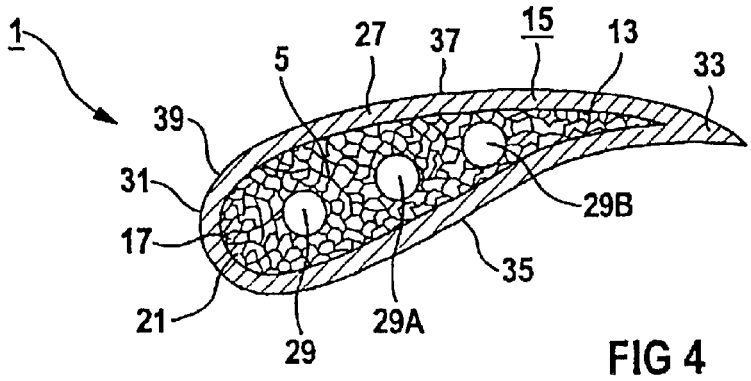
FIG. 4 is a sectional view of the moving blade taken along the line IV—IV shown in FIG. 3.

FIG. 4 shows a sectional view of the moving blade 1 shown in FIG. 3, taken along a sectional line IV—IV. The moving blade 1 has an inlet edge 31 and an outlet edge 33. Further, the moving blade 1 has a delivery side 35 and a suction side 37 located opposite the delivery side 35. A typical blade profile is afforded thereby. The moving blade 1 has an inner region 13 and a casing region 15 surrounding the inner region 13. The casing region 15 forms an outer surface 39 of the moving blade 1, in an operational situation the outer surface 39 being acted upon by a flow medium, for example a hot gas or steam. According to FIG. 4, the casing region 15 is formed of a conventional, for example, metallic solid material 27 not specified in any more detail. The inner region 13 is formed of, at least in regions, of the cellular material 5. The cellular material 5 being formed from a metal foam 21 with a multiplicity of the cells 17 contiguous to one another. Cooling ducts 29, 29A, 29B are provided in the inner region 13, so that the moving blade 1 is configured for interior cooling in an operational situation. In this case, the cooling ducts 29, 29A, 29B are acted upon by a coolant, for example cooling air or cooling steam. The cooling duct 29 serves, for example, for supplying the coolant, while the cooling ducts 29A, 29B serve for discharging the coolant.

The cooling ducts 29, 29A, 29B are formed in the inner region 13 by corresponding recesses of the cellular material 5. The blade 1 of FIG. 3 may in this case be produced, for example, in that the thin-walled casing region 15 forming the blade profile is injection-molded as a hollow mold together with the metal foam 21, corresponding removable or releasable molding cores for the formation of the cooling ducts 29, 29A, 29B being positioned in the inner region 13 before the injection of the metal foam 21. With the construction of the moving blade 1, as shown, the thin-walled casing region 15 is produced, which is supported by the cellular material 5 in the inner region 13 as a supporting structure.

Figure 5:
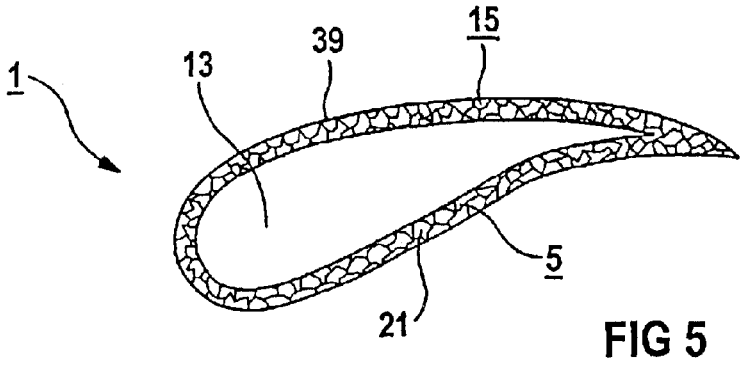
FIGS. 5 and 6 are sectional views of the moving blade having a configuration that is modified in relation to FIG. 4.

An alternative embodiment of the blade profile, shown in FIG. 4, of the moving blade 1 is illustrated in FIG. 5. In this case, the casing region 15 is formed of the metal foam 21 that surrounds the inner region 13. The inner region 13 forms a cavity of the moving blade 1, so that interior cooling is possible. The casing region 15 has the outer surface 39 that is acted upon by a flow medium in an operational situation. In contrast to the variant shown in FIG. 4, the metal foam 21 forms the outer surface 39.

Figure 6:
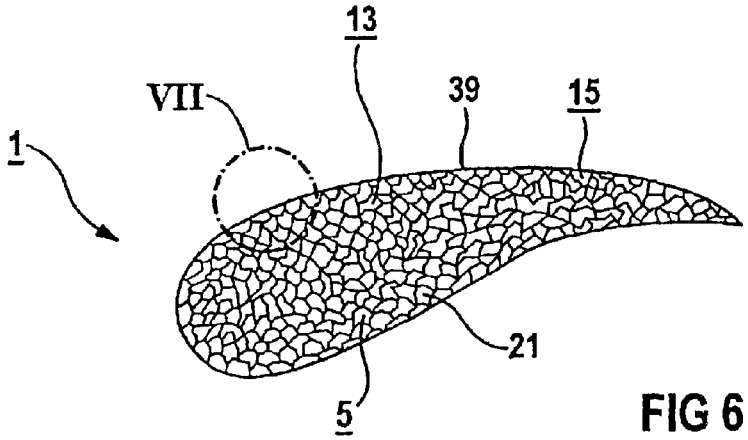

A further variant of the moving blade 1 is shown in a sectional view in FIG. 6. In this case, the blade profile is formed completely of the cellular material 5, the metal foam 21 being provided for this purpose here again. At the same time, in a similar way to what was discussed in connection with FIG. 5, the metal foam 21 forms the outer surface 39. The inner region 13 and the casing region 15 of the moving blade 1 thus are formed of the cellular material 5.

Figure 7:
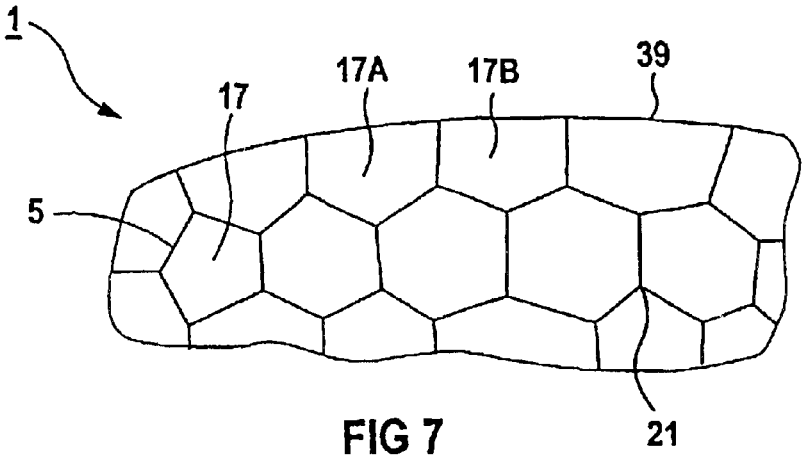
FIG. 7 is an enlarged illustration of a detail VII of the moving blade shown in FIG. 6.

FIG. 7 shows an enlarged detail VII of the moving blade 1 illustrated in FIG. 6. The cellular structure of the material 5, which is provided here by the metal foam 21, is to be illustrated by this.

A multiplicity of cells 17, 17A, 17B are shown, the cells 17A, 17B being contiguous to one another and forming part of the surface 39 of the moving blade 1. In addition, the cells 17 not forming the outer surface 39 are also provided. These cells 17 may also be designated as inner cells 17. The cells 17, 17A, 17B have, for example, a polygonal structure in the sectional view. In a three-dimensional view, this corresponds to polyhedra or linear combinations of polyhedra. By virtue of the structure and configuration of the cells 17A, 17B, the cellular material 5 forms the outer surface 39 with a structure that is closed with respect to the cells 17A, 17B. The outer surface 39 of the moving blade 1 is thus provided, which has a sufficiently low surface roughness, so that, in accompaniment with this, correspondingly low flow losses are ensured when the moving blade 1 is used in a turbomachine (see FIG. 8). Thus, as compared with conventional moving blades 1, a competitive, if not superior, solution is also shown in terms of as smooth a surface as possible. Advantageously, the local surface structure in the region of near-surface cells 17A, 17B contiguous to one another may additionally be markedly lower, in particular, the secondary losses as a result of transverse flows.

Figure 8:
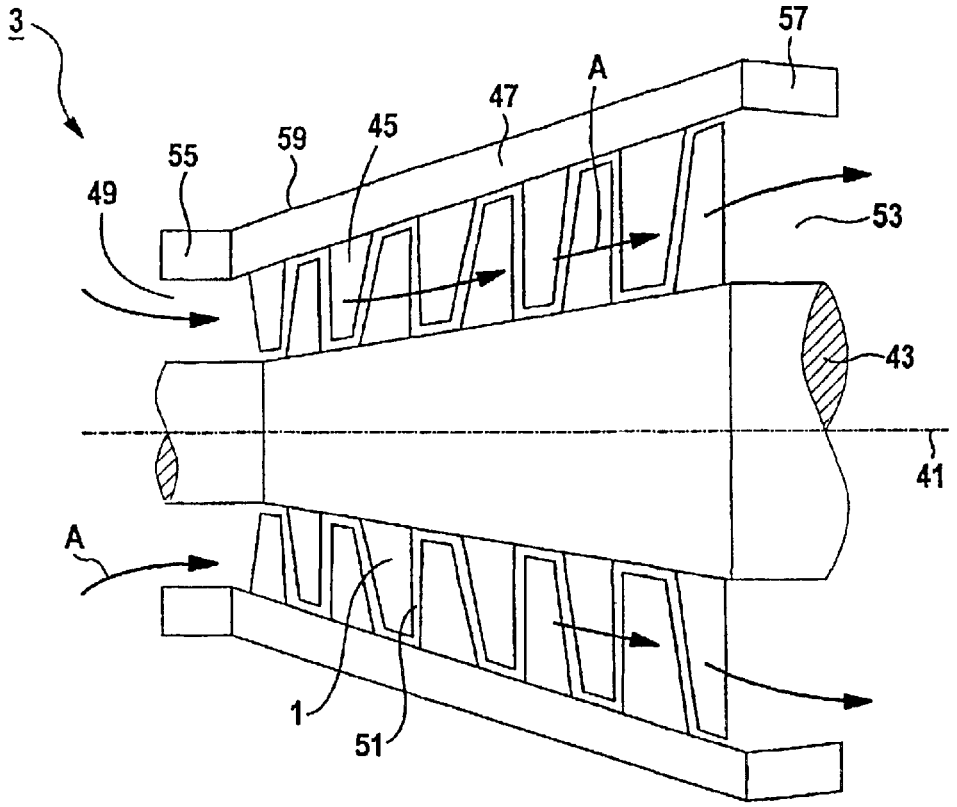
FIG. 8 is a greatly simplified perspective view of a longitudinal section of a turbomachine having moving blades.

FIG. 8 shows a simplified illustration, in a longitudinal section, of a detail of a turbomachine 3 by the example of a low-pressure steam turbine 59. The low-pressure steam turbine 59 has a rotor 43 that extends along an axis of rotation 41 of the steam turbine 59. Further, the low-pressure steam turbine 59 has, successively along the axis 41, an inflow region 49, a blading region 51 and an outflow region 53. Rotatable moving blades 1 and stationary guide vanes 45 are disposed in the blading region 51. The moving blades 1 are in this case fastened to the turbine rotor 43, while the guide vanes 45 are disposed on a guide vane carrier 47 surrounding the turbine rotor 43.

An annular flow duct for a flow medium A, for example hot steam, is formed by the shaft 43, the blading region 51 and the guide vane carrier 47. The inflow region 49 serving for supplying the flow medium A is delimited in the radial direction by an inflow casing 55 disposed upstream of the guide vane carrier 59. An outflow casing 57 is disposed downstream on the guide vane carrier 47 and delimits the outflow region 53 in the radial direction. When the steam turbine 59 is in operation, the flow medium A, here a hot steam, flows from the inflow region 49 into the blading region 51, where the flow medium A, by expansion, performs work and thereafter leaves the steam turbine 59 via the outflow region 53. The flow medium A is subsequently collected in a condenser, not illustrated in any more detail in FIG. 8, for the steam turbine 59, the condenser being located downstream of the outflow casing 57.

When flowing through the blading region 51, the flow medium A expands and performs work on the moving blades 1, with the result that these are set in rotation. The moving blades 1 of the low-pressure steam turbine 51 are formed of, at least in regions, of the cellular material 5, as described in FIGS. 2 to 7.

As a result, the moving blades 1 have a lower density, as compared with conventional moving blades 1 (see FIG. 1), and are not subjected to such high loads as a result of the centrifugal force. The moving blades 1 form the low-pressure blading of the low-pressure steam turbine 59. By the cellular material 5 being used in regions for the moving blades 1, moving blades 1 with a larger radial dimension can be used by virtue of the density advantage, so that a larger flow cross section with lower losses for the steam turbine 59 is implemented.

In addition to the moving blades 1, the guide vanes 45 may also be formed of in regions of the cellular material 5, so that both the moving blades 1 and the guide vanes 45 in a lightweight form of construction can be used in the blading region 51. Furthermore, it is possible for the novel blade concept to be applied to other types of turbomachines 3. Thus, the blading of a gas turbine, a compressor, a high-pressure or medium-pressure part turbine of a steam turbine plant may have moving blades 1 and/or guide vanes 45 with the cellular material 5, in particular a metal foam 21.

I claim:

1. A moving blade for a turbomachine, comprising:

a moving blade body adapted for mounting on the turbomachine, said moving blade containing, at least in regions, a cellular material and an outer surface, said cellular material having cells forming said outer surface with a structure being closed with respect to said cells and said moving blade body having a fastening region, said cellular material being provided in said fastening region.

2. The moving blade according to claim 1, wherein said moving blade body contains a blade leaf region having said cellular material.

3. The moving blade according to claim 1, wherein said moving blade body is a body selected from the group consisting of gas turbine moving blades, steam turbine moving blades, low-pressure steam turbine moving blades, and compressor moving blades.

4. The moving blade according to claim 1, wherein said fastening region is a blade foot.

5. A moving blade for a turbomachine, comprising:

a moving blade body adapted for mounting on the turbomachine, said moving blade containing, at least in regions, a cellular material being a metal foam and an outer surface, said cellular material having cells forming said outer surface with a structure being closed with respect to said cells.

6. The moving blade according to claim 5, wherein said metal foam has a density between about 5% and 50% of a density of a solid material.

7. The moving blade according to claim 6, wherein said density of said metal foam is between about 8% and 20% of the density of the solid material.

8. The moving blade according to claim 5, wherein said metal foam contains a material resistant to high temperature.

9. The moving blade according to claim 8, wherein said metal foam contains a material selected from the group consisting of nickel-based alloys and cobalt-based alloys.

10. A turbomachine, comprising:

a moving blade containing, at least in regions, a cellular material and an outer surface, said cellular material having cells forming said outer surface with a structure being closed with respect to said cells and said moving blade body having a fastening region, said cellular material being provided in said fastening region.

11. The turbomachine according to claim 10, wherein the turbomachine is selected from the group consisting of gas turbines, steam turbines, low-pressure steam turbines, and compressors.

12. A turbomachine, comprising:

a moving blade containing, at least in regions, a cellular material being a metal foam and an outer surface, said cellular material having cells forming said outer surface with a structure being closed with respect to said cell.

13. A moving blade for a turbomachine, comprising:

a moving blade body adapted for mounting on the turbomachine, said moving blade containing, at least in region, a cellular material and an outer surface, said cellular material having cells forming said outer surface having a closed porous structure and said moving blade body including a blade leaf region formed entirely of said cellular material.

* * * * *